US007909330B2

(12) United States Patent
Domjen

(10) Patent No.: US 7,909,330 B2
(45) Date of Patent: Mar. 22, 2011

(54) SOCCER TRAINING AID

(76) Inventor: Peter A. Domjen, Frenchs Forest (AU)

( * ) Notice: Subject to any disclaimer, the term of this patent is extended or adjusted under 35 U.S.C. 154(b) by 109 days.

(21) Appl. No.: 12/161,152

(22) PCT Filed: Jan. 20, 2007

(86) PCT No.: PCT/AU2007/000046

§ 371 (c)(1),
(2), (4) Date: Jul. 16, 2008

(87) PCT Pub. No.: WO2007/082344

PCT Pub. Date: Jul. 26, 2007

(65) Prior Publication Data

US 2010/0016101 A1 Jan. 21, 2010

(30) Foreign Application Priority Data

Jan. 20, 2006 (AU) ..... 2006200246

(51) Int. Cl.
*A63B 69/00* (2006.01)

(52) U.S. Cl. ..... 273/396; 473/435

(58) Field of Classification Search ..... 273/395, 273/396; 473/434, 435

See application file for complete search history.

(56) References Cited

U.S. PATENT DOCUMENTS

| | | | | |
|---|---|---|---|---|
| 2,812,946 | A | 11/1957 | Hughes | |
| 3,001,790 | A * | 9/1961 | Pratt | 473/434 |
| 3,697,068 | A * | 10/1972 | McDougall | 473/434 |
| 4,133,531 | A * | 1/1979 | Arteaga et al. | 273/395 |
| 4,258,924 | A | 3/1981 | Ketchum | |
| 4,334,681 | A * | 6/1982 | Scheie | 473/465 |
| 4,373,720 | A * | 2/1983 | Lombardi et al. | 473/434 |
| 4,852,889 | A * | 8/1989 | Tomczak | 473/473 |
| 5,407,210 | A * | 4/1995 | Canning | 273/348 |
| 5,531,449 | A * | 7/1996 | Denton | 273/348 |
| 5,558,338 | A * | 9/1996 | Taub | 473/416 |
| 5,580,048 | A * | 12/1996 | Mullen et al. | 473/435 |
| 5,795,252 | A * | 8/1998 | Crucet | 473/434 |
| 5,967,519 | A * | 10/1999 | Cumberland et al. | 273/317.6 |
| 6,213,900 | B1 * | 4/2001 | Steyn et al. | 473/434 |
| 6,676,545 | B1 | 1/2004 | Beazley | |
| 7,249,767 | B1 * | 7/2007 | Gorton | 273/396 |
| 2003/0013561 | A1 * | 1/2003 | Sompolinsky | 473/435 |
| 2003/0236139 | A1 | 12/2003 | Jensen | |
| 2004/0140621 | A1 * | 7/2004 | Liao | 273/396 |
| 2004/0176193 | A1 * | 9/2004 | Valliquette | 473/435 |
| 2006/0089213 | A1 * | 4/2006 | Snyder | 473/435 |
| 2009/0146377 | A1 * | 6/2009 | Gelzinis et al. | 273/396 |

FOREIGN PATENT DOCUMENTS

| | | |
|---|---|---|
| DE | 3106135 | 9/1982 |
| EP | 241211 | 10/1987 |
| EP | 01297866 | 4/2003 |
| GB | 02292690 | 3/1996 |
| GB | 023007646 | 6/1997 |
| GB | 20386327 | 9/2003 |
| JP | 20020655926 | 3/2002 |
| WO | WO99039784 | 8/1999 |

* cited by examiner

*Primary Examiner* — Mark S Graham
(74) *Attorney, Agent, or Firm* — Galbreath Law Offices, P.C.; John A. Galbreath

(57) ABSTRACT

A rebound wall (10) for a ball game includes a base unit (12) and a wall unit (14). The wall unit may be located in at least two different positions relative to the base unit to change how the ball rebounds from the device.

19 Claims, 11 Drawing Sheets

SOCCER TRAINING AID

FIELD OF INVENTION

This invention relates to soccer and other ball sport training aids and more particularly to a soccer training aid that may be used by a single person or multiple people.

SUMMARY OF THE INVENTION

In one broad form the invention provides a rebound wall for ball games including a face, against which a ball may be struck, the face having a lower portion and an upper portion, wherein the upper portion can be located in at least two different positions relative to the lower portion In another broad form the invention provides a rebound wall for ball games including a face, against which a ball may be struck, the face having a lower portion and an upper portion, wherein the lower portion is angled downwards and backwards relative to the vertical.

In yet another broad form the invention provides a rebound wall for ball games including a face, against which a ball may be struck, the face having at least two portions, a ball rebounding differently from each of the portions.

Preferably one of the portions is located adjacent the ground and angled so a ball rolled, kicked, thrown or otherwise projected on the ground against the portion will rebound from the portion along the ground.

A part of the portion may be movable to form or reveal a surface angled so a ball rolled, kicked, thrown or otherwise projected on the ground against the surface will be raised upwards and preferably, if projected with sufficient speed, rebounded from the surface upwards into the air.

Preferably another of the portions is angled so a ball kicked, thrown or otherwise projected in the air against the another portion will be raised upwards and preferably, if projected with sufficient speed, rebounded from the another portion upwards into the air.

In a further broad form the invention provides a rebound wall for ball games including a face, against which a ball may be struck, the face having a lower portion and an upper portion, wherein the lower portion is angled downwards and backwards relative to the vertical, and the upper portion is angled upwards and backwards relative to the vertical.

The face may include a curved section. Where the face includes at least two portions or an upper portion and a lower portion, said upper portion may be angled relative to the lower portion.

The upper portion may be located in at least two different positions relative to the lower portion The lower portion may be angled downwards and backwards relative to the vertical. The lower portion may be angled downwards and backwards at about 5 degrees to the vertical.

One of the positions the upper portion may be is approximately vertical. The upper portion may be between 0 and 45 degrees to the vertical. A preferred one of the positions is approximately 30 degrees to the vertical.

The rebound wall may have a base unit and a wall unit, the wall unit being mountable on the base unit.

The base unit may include first engagement means and the wall unit may include second engagement means complementary to the first engagement means, whereby the base unit and wall unit may be engaged together.

The wall unit or the base unit may include at least two sets of first or second engagement means, the wall unit positioned differently relative to the base unit when each set of engagement means is engaged.

The first and second engagement means may include sockets and complementary protrusions. The first engagement means may include at least one socket and the second engagement means may include at least one protrusion.

The wall unit may include a lower edge and one second engagement means may include at least one protrusion extending from the lower edge.

The wall unit may include an upper edge and one second engagement means may include at least one protrusion extending from the upper edge.

The wall unit may be mounted on the base unit for rotation about an axis.

The rebound wall may include at least one strut extends between the wall unit and the base unit. The base unit may include at least two mounting locations for the or each strut. Each mounting location may include a recess into which the strut is received.

DETAILED DESCRIPTION OF PREFERRED AND OTHER EMBODIMENTS

Referring to FIGS. 1 to 9 there is provided a rebound wall 10. The rebound wall comprises two main components, a base 12 and an upright wall 14. An optional weight base 16 is provided upon which the base 12 may be positioned.

Figure 4:
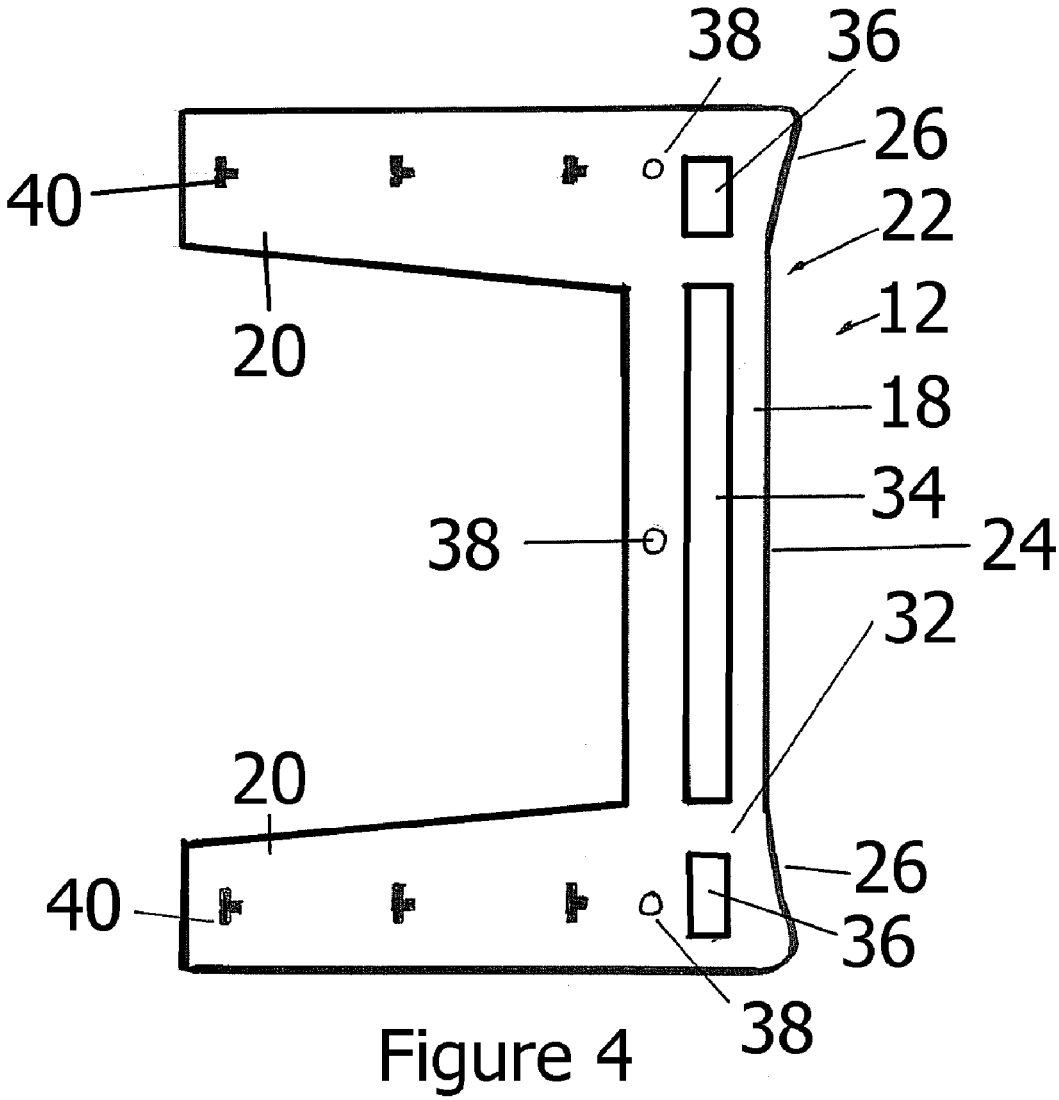
FIG. 4 is a plan view of the base component of the FIG. 1 embodiment.
Figure 5:
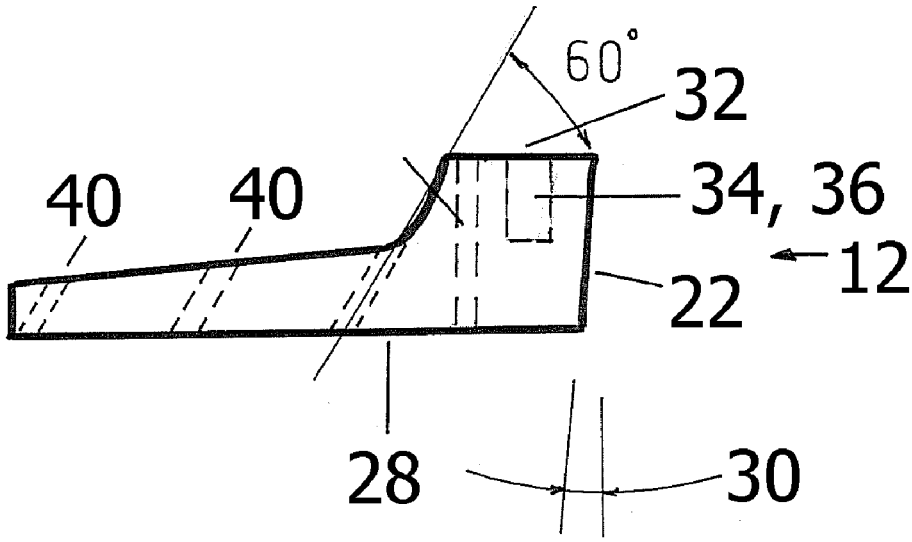
FIG. 5 is a side view of the base component.

The base 12 is preferably formed of a hollow plastics moulding and has a central portion 18 and two legs 20 extending rearward from either side. In the preferred embodiment the base is about 1000 mm wide and 700 mm deep. The front face 22 of the central portion has a planar central portion 24 and outer portions 26. It is about 100 mm high. As seen in FIG. 4, the outer portions in plan view are project forward. In the preferred embodiment these outer portions are curved forward and are most preferably elliptical. If desired the outer portions may be generally planar and angled forward. This is preferred and not essential and the entire front face may extend in a single plane. As seen in FIG. 5, the front face 22 is not vertical (90 degrees) to the base surface 28 but extends upwards and forwards relative to the base surface 28. In the preferred embodiment this angle 30 is about 5 degrees. This is preferred and not essential and the front face may extend at or about 90 degrees to the vertical. If desired the face may extend backwards. A range of about 5 degrees either side of vertical (i.e. ±5 degrees) is acceptable.

The mass of the base 12 and the upright wall 14 together is preferably 12 to 15 kg. In the preferred embodiment the base 12 is hollow and may be filled with suitable ballast, such as water or sand, to increase the mass of the unit.

The top face 32 of the central portion is complementary to the base surface of the upright wall 14. The top face 32 has a central "hump" 33 that engages in a complementary recess 35 in the base surface of the upright wall 12. This hump aids in locating the two components together and is not essential. If desired, top face 32 may be planar and extend in a horizontal plane parallel to the base surface 28. It is not essential that the face 32 be planar or parallel to the base surface 28 but merely that it be complementary to the base surface of the upright wall 14

The upper face 32 has a central slot 34 that extends across most of the width of the central portion 18 and two outer slots 36 at either side of the central slot 34. As seen in FIG. 5, these slots 34, 36 are rectangular in cross section and extend generally vertically downwards.

Located behind the slots 34, 36 are a series of vertical bores 38 that extend through the central portion 18. These are for insertion of retaining pegs and are generally of a circular cross section. The circular cross section is not essential and other shapes may be used instead.

Located in the legs 20 are a series of bores 40 that extend downwards and rearwards at about 30 degrees to the vertical. These are also for insertion of retaining pegs and are generally of a T-shaped cross section. The T-shape is preferred but not essential and other shapes maybe used instead.

Figure 1:
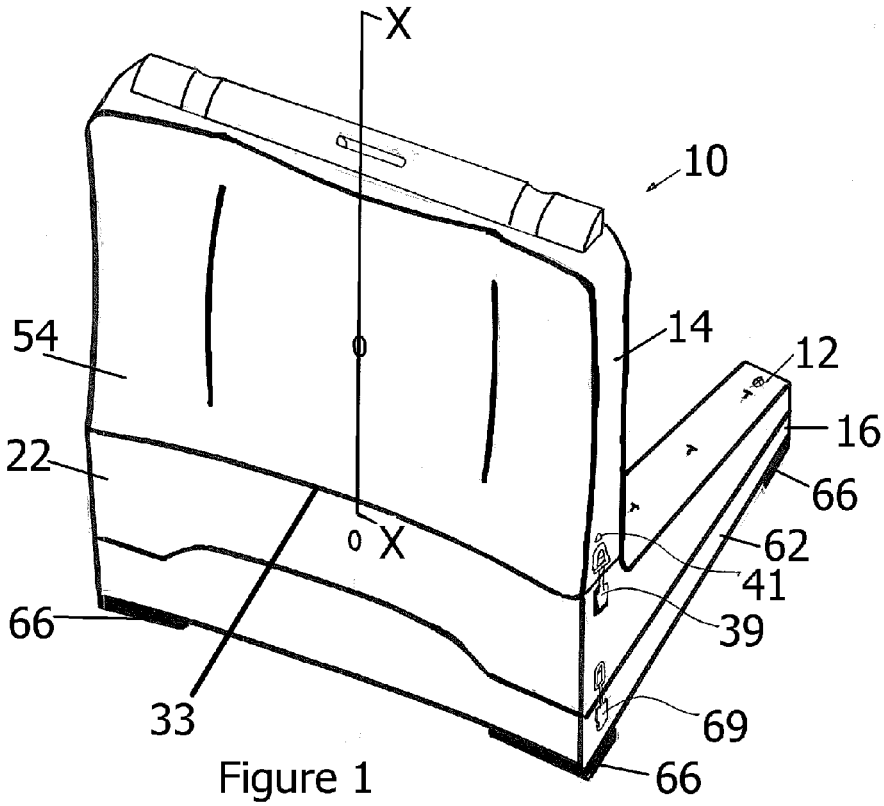
FIG. 1 is a front perspective view of a first embodiment of the invention.
Figure 7:
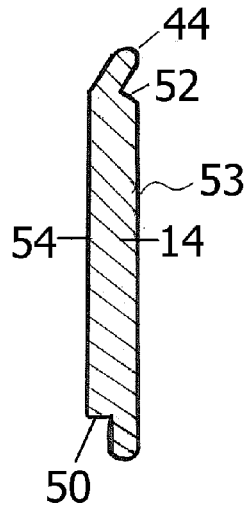
FIG. 7 is a cross sectional view of the upright wall component taken along line XX of FIG. 1.
Figure 2:
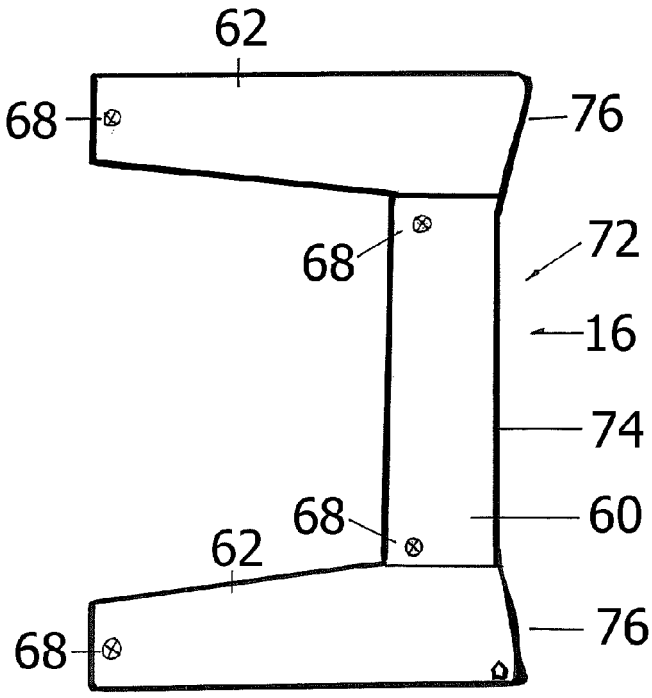
FIG. 2 is a plan view of the weight base component of the FIG. 1 embodiment.
Figure 3:
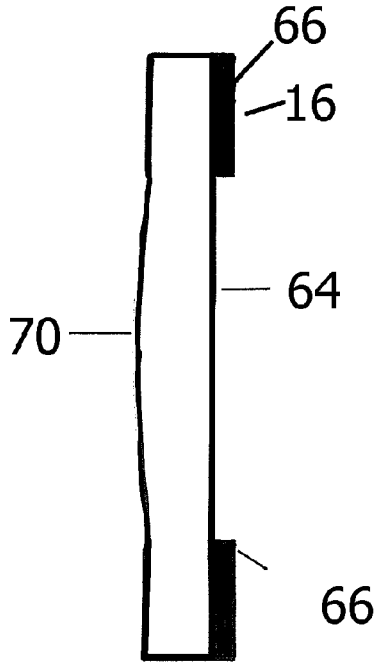
FIG. 3 is a side view of the weight base component.

The upright wall 14 has a width corresponding to the width of the base. The wall has a lower face 50 and an upper face 52. The lower face 50 extends at about 90 degrees to the front face 54. Extending downwards from the lower face 50 are central protrusion 42 and side protrusions 44. These protrusions are sized and located to be inserted into the slots 34 and 36 in the base and extend at about 90 degrees to the lower face 50. When assembled, the lower face bears against the upper face 38 of the base with the protrusions 42, 44 located in the slots 34 and 36, as shown in FIG. 1. Latches 39 on either side of the device lock the two components together and hold the upright wall 14 securely against the base unit 12 so there is minimal movement of the upright wall 14 relative to the base unit 12. The amount a ball rebounds from the upright wall 14 depends on how much movement, if any, there is between the upright wall 14 and the base 12. The latches are adjustable by way of multiple fixing locations 41 to allow the user to vary how tight the two components are held together and hence how much rebound there is in the unit.

Figure 8:
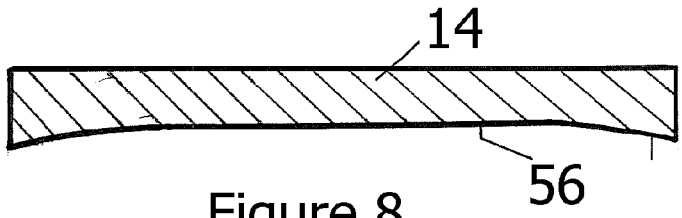
FIG. 8 is a cross sectional view of the upright wall component taken along line YY of FIG. 6.
Figure 9:
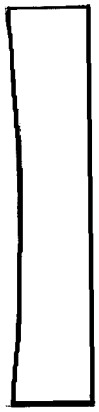
FIG. 9 is a side view of the upright wall component.
Figure 6:
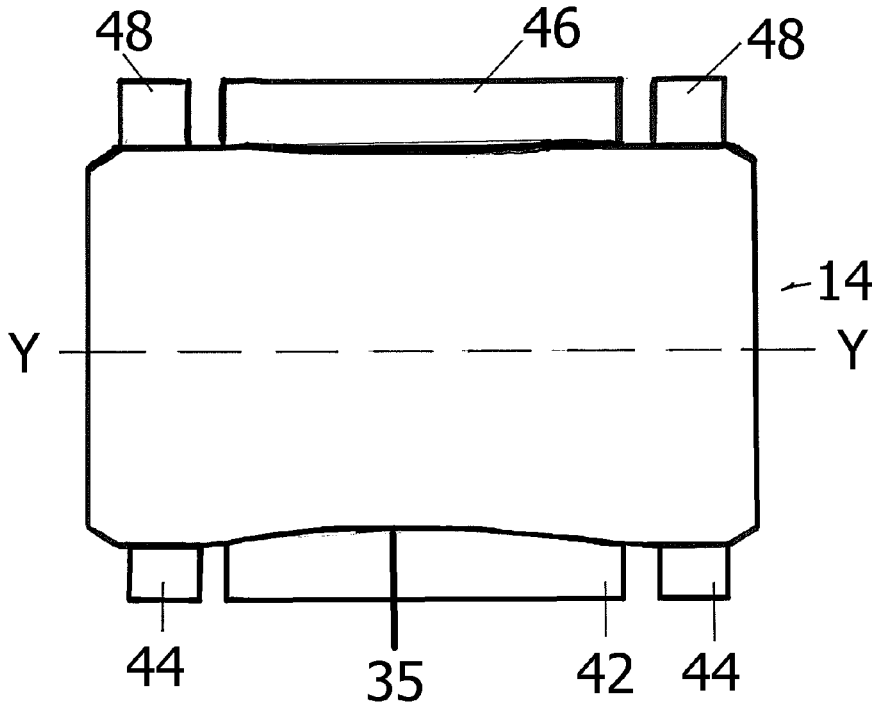
FIG. 6 is a front view of the upright wall component of the FIG. 1 embodiment.

In this configuration the front face 54 of the upright wall 14 extends generally vertically, as seen in FIG. 1. The front face 54 has a similar configuration to the front face 24 of the base and so has a generally planar central portion 56 and side portions 58 that extend forward, as seen in FIG. 8. However, the front face 54 need not be vertical and may be within about 5 to 10 degrees of vertical. If not vertical the front face 54 is preferably angled backwards rather than forwards to cause a ball to rebound upwards from itself.

The upright wall 14 is designed so that it may be rotated about a horizontal axis and its upper face 52 engaged with the upper face 32 of the base 12 to provide a different configuration.

The top face 52 of the upright wall 14 does extend at 90 degrees to the front face but instead extends at about 30 degrees to the horizontal. Extending upwards from the upper face 52 are central protrusion 46 and side protrusions 48. These protrusions are sized and located to be inserted into the slots 34 and 36 in the base and extend at about 90 degrees to the upper face 52, i.e. at about 30 degrees to the vertical. When assembled in this configuration, the upper face 52 bears against the upper face 38 of the base with the protrusions 46, 48 located in the slots 34 and 36. However, because the upper face 52 and the protrusions are angled relative to the front face 54, the front face is angled backwards, at about 30 degrees to the vertical. However, the front face 54 need not be at exactly 30 degrees and may be angled in a range from about 0 degrees to about 45 degrees to the vertical.

Thus depending on which of the upper of lower faces is engaged with the base, the front face may be substantially vertical or angled backwards.

It will be appreciated that multiple sets of sockets may be provided on the base unit to allow the angle of the wall to be varied. Further, the base may be provided with protrusions and the wall unit with sockets.

The rebound wall 10 may be used with just the two main components, the base 12 and the upright wall 14. When used with just these components it is best to secure the device e to the ground. Accordingly, stakes or pegs may be inserted through one or more of the T-shaped bores 40 in the base into the ground. This secures the device against significant movement.

Figure 18:
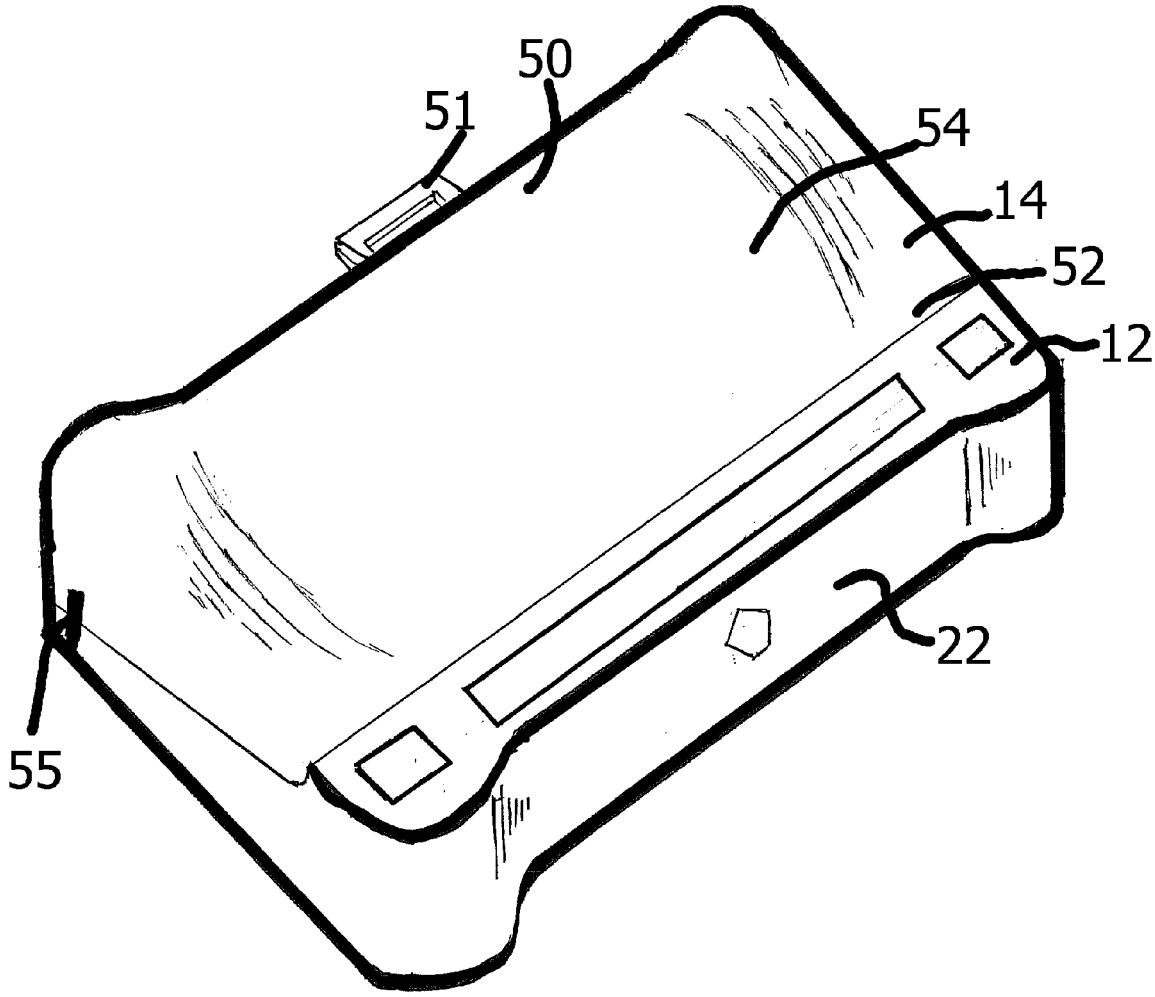
FIG. 18 is a perspective view of a variation of the FIG. 1 embodiment in a storage configuration.

FIG. 18 shows a variation in which the base 12 and upright wall 14 may be reconfigured for storage or transport. When the upright wall 14 is detached from the base 12, it may be rotated so its rear face 53 overlies the legs with the upper face 52 engaging the rear of the front portion of the base 12. The protrusions 44 extend into complementary slots (not shown) in this rear facing surface. The lower face 50 is at the free end of the legs. Latches 55 secure the two components together. Thus the two components form a relatively compact, suitcase, sized object. To aid in transport, a handle 51 may be provided.

Where it is not possible to drive stakes or pegs into the ground, such as when used on an asphalt or concrete surface, the optional weight base 16 may be used. The weight base 16 has a shape in plan view similar to that of the base 12 and accordingly has a central portion 60 and two legs 62 extending backwards from either end of the central portion. The weight base is about 100 mm high. The weight base 16 is hollow and may be filled with water or sand or other suitable material and when filled with water has a mass between about 20 and 40 kg, preferably between about 30 and 40 kg. The underneath surface 64 is provided with rubber feet 66. at the ends of the central portion 60 and at the free ends of the legs. These feet 66 aid in preventing movement of the device during use. The base 12 merely sits on top of the weight base and is secured in position by protrusions 68 on the upper surface 70 of the weight base that extend into complementary recesses provided on the lower surface 28 of the base.

The weight base 16 and base 12 are secured together using latches 69. Again there may be multiple fixing locations to adjust the tightness of their engagement.

The front face 72 of the weight base is angled at a similar angle to the front face 22 of the base, about 5 degrees to the vertical. If desired, the face 72 may be vertical. As with the face 22, the face 72 has a central, planar, portion 74 and two angle portions 76.

In use, a player stands in front of the rebound wall 10, facing the upright wall 14 with the legs behind the upright wall. The player kicks a ball toward the upright wall 14. The ball hits the upright wall 14, the front face 22 of the base 12 or the front face 72 of the weight base 16. The ball will then rebound to the player. If the ball hits either of the faces 22 and 72, the angling will rebound the wall toward the ground.

In the configuration shown in FIG. 1, the face 54 of the upright wall 14 is generally vertical. If the ball hits the face 54 of the upright wall, it may rebound upwards or generally horizontally toward the player. The player may trap the ball and then kick it against the rebound wall again. The angled edge portions of the three components aid in returning the ball toward the player. The lower face 52 enables the player to kick the ball on the ground and have the ball return along the ground. The slight downward angle discourages the ball from rebounding into the air.

In the other configuration, in which the upright wall is angled backwards at about 30 degrees, if the ball hits the face 54, it will rebound upwards. This enables the player to practice trapping a ball with their chest or legs with the ball falling at a relatively steep angle or to practice heading the ball.

Whilst the angled portions are useful in returning the ball towards the player, they are not essential to the invention. Further, whilst the preferred embodiment has a generally planar portion and two angled portions, which are also planar, other shapes may be used. For example, the front surface may be a concave shape with a curved surface of a constant radius or of a variable radius. The central portion may be planar and the edge portions curved. Other configurations of the surfaces may be used.

Figure 24:
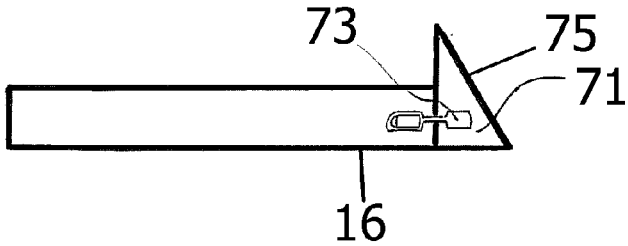
FIG. 24 shows an add-on angled wall for use with the invention.

FIG. 24 shows an add-on angled wall 71 that may be attached to the front of the weight base 16 by latches 73. The angled wall 71 extends in front of both the weight base 16 and the base 12 and provides an angled front surface 75. A player may kick a ball along the ground so that it contacts the surface 75. The angled surface causes the ball to rebound into the air rather than along the ground. If desired, the angled wall may be used with just the weight base 16 or with the weight base and the rebound wall. An angled wall configured to only attach to the base 12 may also be provided.

Figure 10:
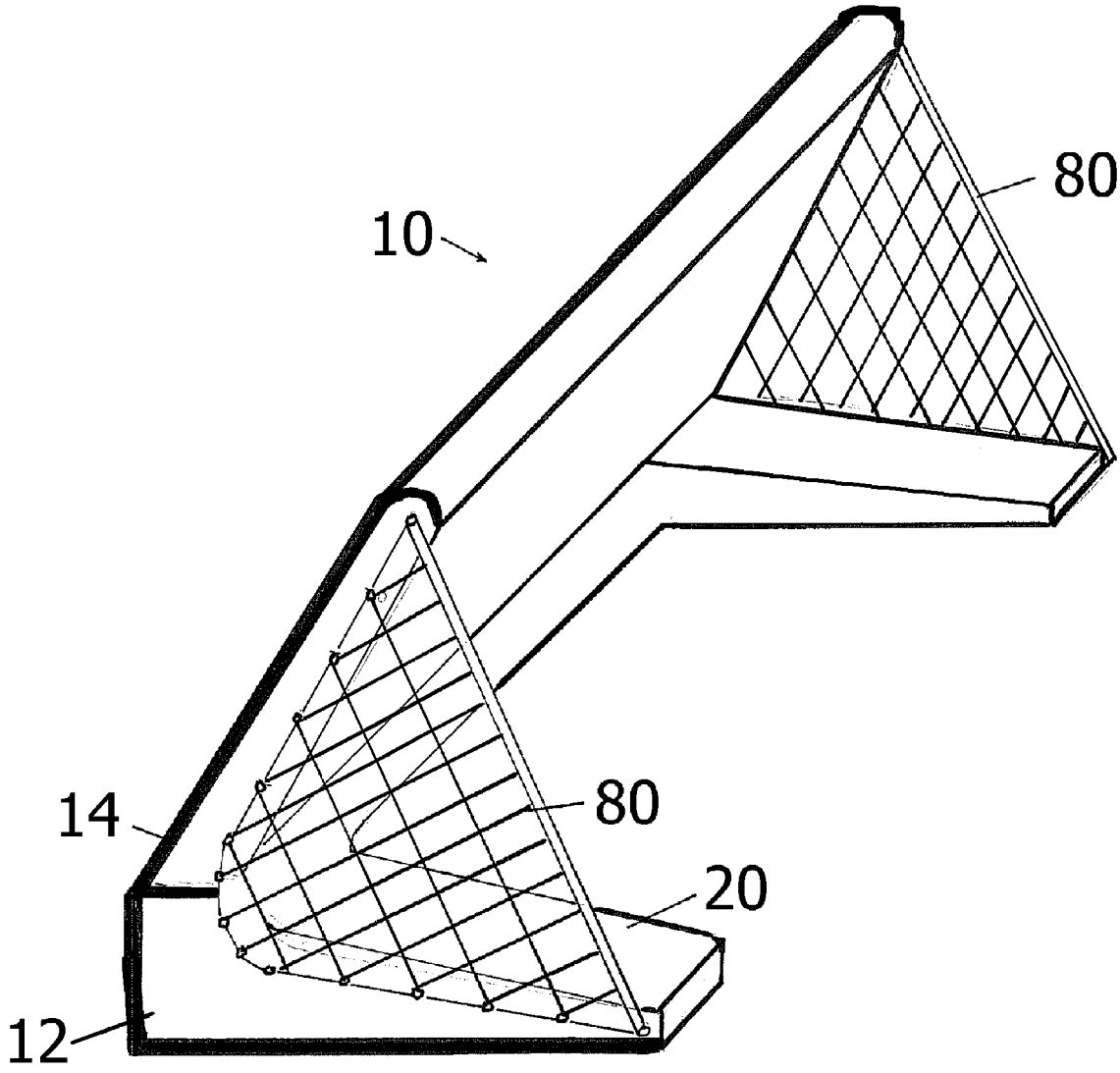
FIG. 10 is a rear perspective view of a first embodiment with an optional net.

FIG. 10 shows the rebound wall 10 in the angled configuration and turned around. Netting 80 extends from the sides of the upright wall 14 to the sides of legs the base 12. The device thus forms a goal that may be used for target practice or for a game.

Figure 11:
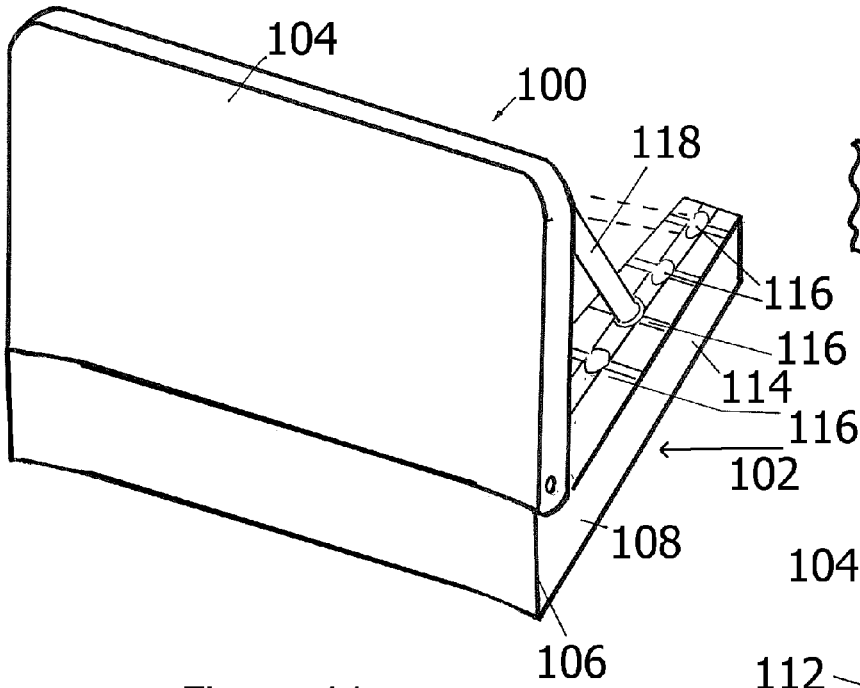
FIG. 11 is a front perspective view of a second embodiment of the invention.
Figure 12:
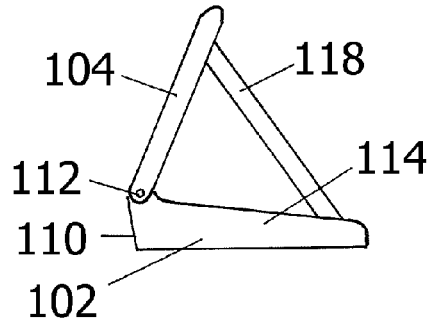
FIG. 12 is a side view of a second embodiment of the invention.

A rebound wall 100 according to a second embodiment of the invention is shown in FIGS. 11 and 12. The rebound wall 100 has a base 102 and an upright wall 104. The base has a U-shaped configuration similar to that of the first embodiment and so has a central portion 106 with legs 108 extending rearwards from either end.

The front face 110 is planar and angled at about 5 degrees to the vertical, with the upper edge forward, similar to the face 22 of the first embodiment.

The upright wall 104 is mounted to the base 102 about axis 112 and may be pivoted to one of a number of positions. The top surface 114 of the legs 108 have a series of blind bores 116. Struts 118 extend into one of the bores 116 of each leg and brace the upright wall 104 at a set angle. By changing the bore 116 into which the struts are inserted, the angle of the upright wall may be varied.

Alternatively each leg 114 may be provided with a longitudinally extending slot having a sawtooth surface and the end of the struts may have a complementary sawtooth surface that engages the slot. This allows a greater range of adjustment.

Figure 17:
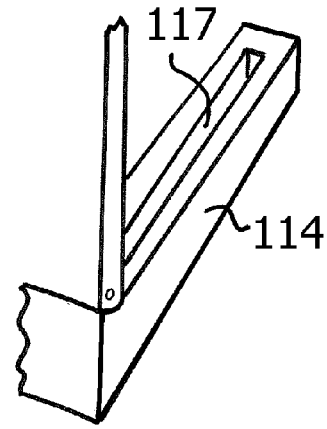
FIG. 17 is a shows a variation of the leg of the FIG. 11 embodiment.

FIG. 17 shows a variation in which each leg 114 has a slot 117 that extends through the leg 114. The bracing struts 118 pass through the slot and engage in the ground upon which the base sits. This also allows a wider range of adjustment.

Although the embodiment of FIGS. 11 and 12 is shown with planar front faces, it will be appreciated that the front faces may be configured as per the FIG. 1 embodiment or as discussed earlier.

Figure 14:
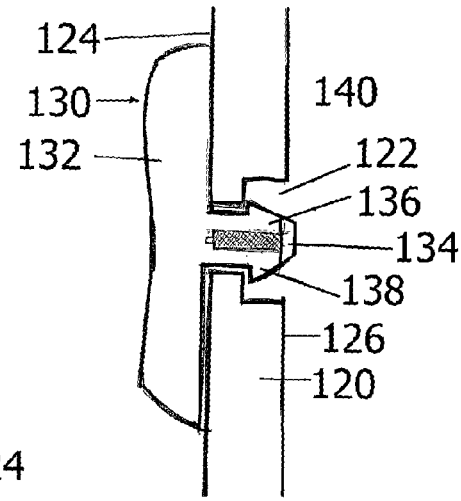
FIG. 14 is a side cross sectional of part of the third embodiment and the target.
Figure 13:
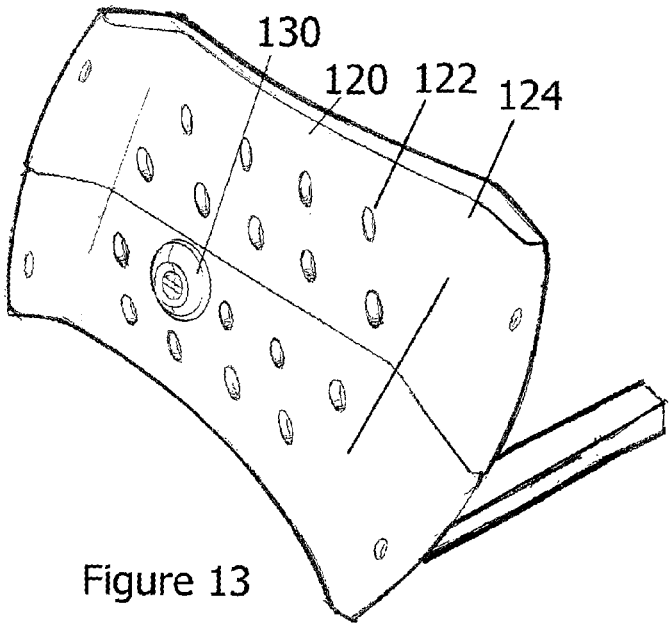
FIG. 13 is a front perspective view of a third embodiment of the invention with an optional target.
Figure 15:
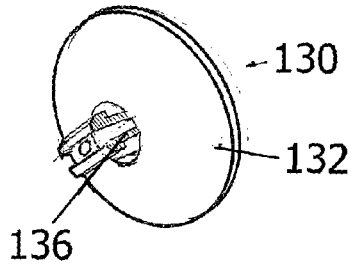
FIG. 15 is a rear perspective view of the optional target.

FIGS. 13 to 16 show modifications that may be applied to the embodiments of invention. An upright wall 120 is provided with a series of apertures 122 in its front face 124. As seen in FIG. 14 the bores 122 are countersunk from the rear face 126 of the upright wall 120.

One or more targets 130 are provided that may be attached to the front face via one of the bores 122. Each target 130 comprises a disc 132 with a fixing extending 134 extending from the centre of the rear of the disk. The fixing realisably engages in the countersunk bore 122 and secures the target to the upright wall. In the embodiment shown the fixing has two or more resilient legs having re-entrant barbs at their free ends. The fixing may be inserted into the bore, pushing the legs toward each other until the barbed portion clears the smaller diameter portion 140. At this point the legs spring outwards and secure the target in place. To release, the legs are pushed together and the target withdrawn form the upright wall.

Figure 16:
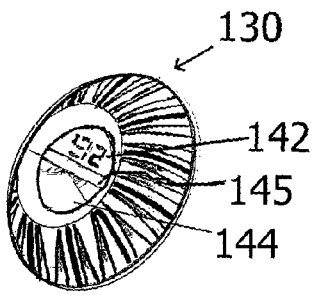
FIG. 16 is a front perspective view of the optional target.

The target may include a clock or a counter 142 or both, as shown in FIG. 16. The counter increments when struck by a ball with sufficient force. A light 144 may be provided that briefly lights up when the target is struck. The target is preferably hollow and flexible, such that when hit with a ball it compresses. A slot 145 may be provided to allow air within the target to escape. The slot may be configured to whistle or other wise make a noise when air is forced out when struck by a ball. Accordingly, a user may practice hitting the target and be provided with feedback as to when and/or how many times the target is hit. When used with a clock the user may attempt to hit the target as many times in a set period. If desired, the wall itself may be provided with a clock and counter separate from the target. Thus the user may use the wall without a target. The clock and counter may be used to determine how many times the user can kick a ball against the wall in a set period of time.

Figure 19:
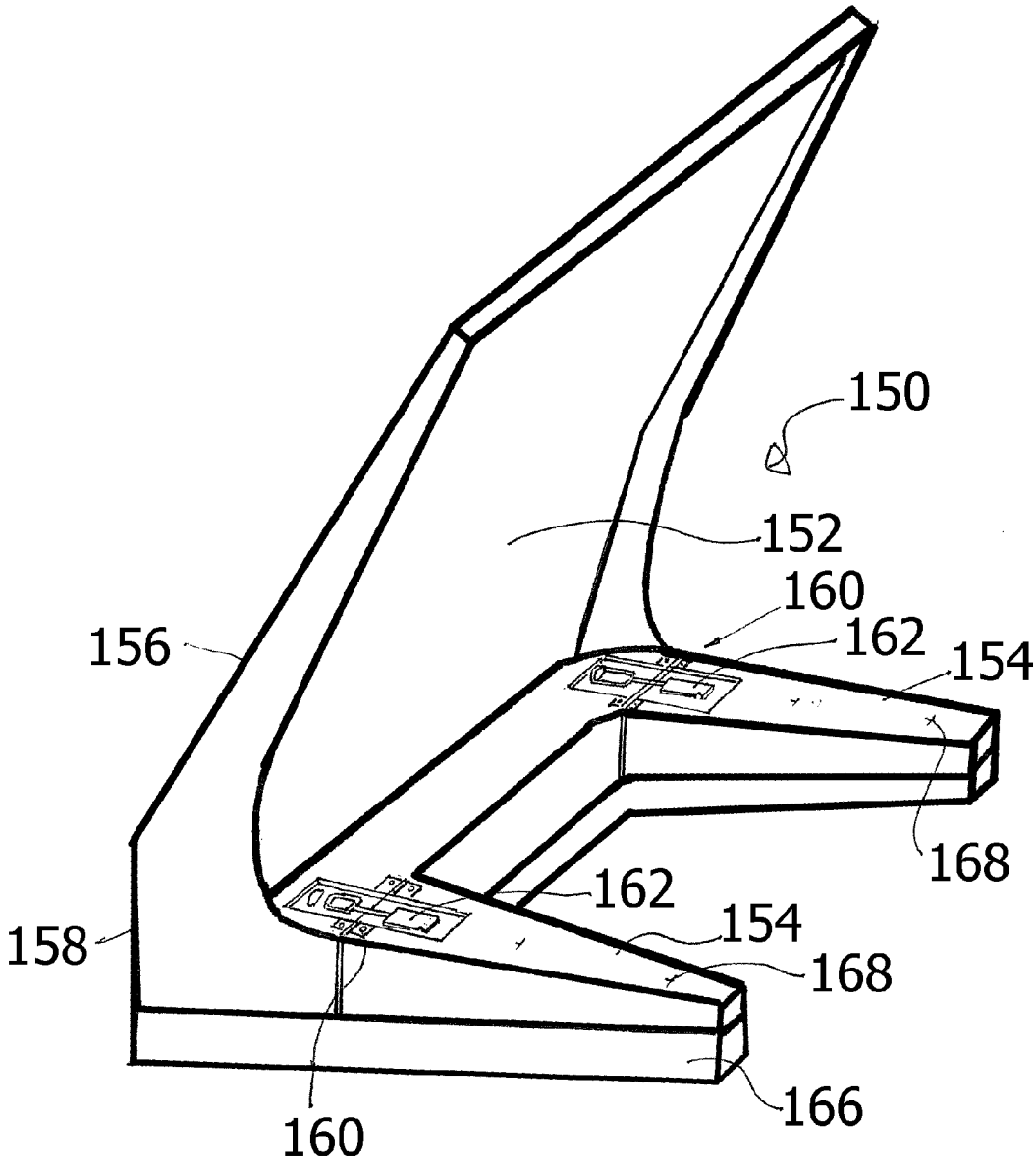
FIG. 19 is a rear perspective view a further embodiment of the invention.
Figure 20:
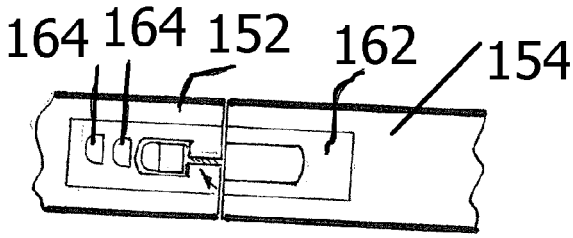
FIG. 20 is a view of the locking mechanism of the FIG. 19 embodiment.

FIGS. 19 and 20 show a rebound wall 150 according to a further embodiment of the invention. The rebound wall 150 has a front panel 152 and two rearward extending legs 154.

The front panel 152 has an upper face 156 and a lower face 158. The upper and lower faces 156, 158 are fixed relative to each other. The dimensions of the faces 156, 158 are similar to the other embodiments and accordingly, the lower face 158 is about 100 mm high. The lower face 158 may be vertical or may extend at an angle to the vertical, either forwards or backwards. Preferably the lower face extends downwards and backwards at about 5 degrees to the vertical. The upper face 156 extends upwards and backwards at about 30 degrees to the vertical. It will be appreciated these angles may be varied.

The legs 154 are attached to the front panel by hinges and may be rotated into the rear of the front panel about hinges for easier storage or transport. The legs are held in position by over centre latches 162. The latches are provided with multiple fixing locations 164 on the front panel such that the tightness of the latches when closed can be adjusted, so as to vary the amount a ball rebounds from the front face. It will be appreciated that the locations may be on the legs 154.

The rebound wall 150 may be affixed to the ground as per the FIG. 1 embodiment, using pegs or the like through apertures 168. These apertures are configured similarly to the apertures of 40 of the FIG. 1 embodiment. The wall may also be mounted n a weight base 166. The weight base 166 is configured similarly to the weight base 16 of the FIG. 1 embodiment.

Figure 21:
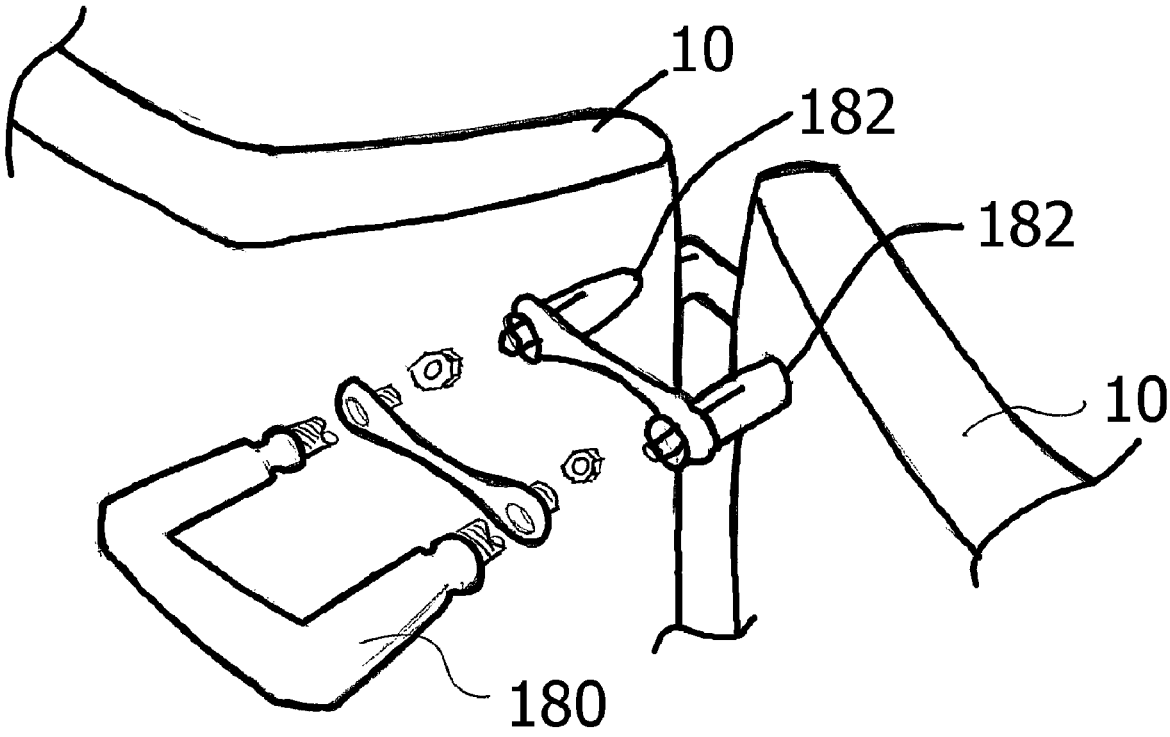
FIG. 21 is shows the joining together of two units of the invention.

The embodiments of the invention may be joined together side by side. FIG. 21 shows two rebound wall units 10 joined together by suitable fasteners 180 passing though suitable bores in the units 10. Other fasteners may be used.

Figure 22:
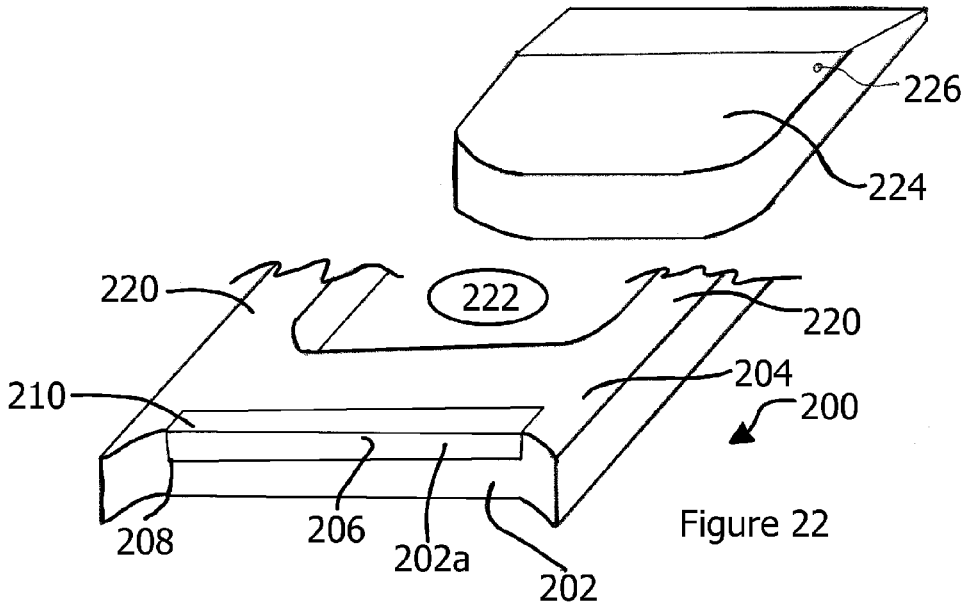
FIG. 22 is a perspective view of another variation of the invention in a first configuration, together with a ballast unit.
Figure 23:
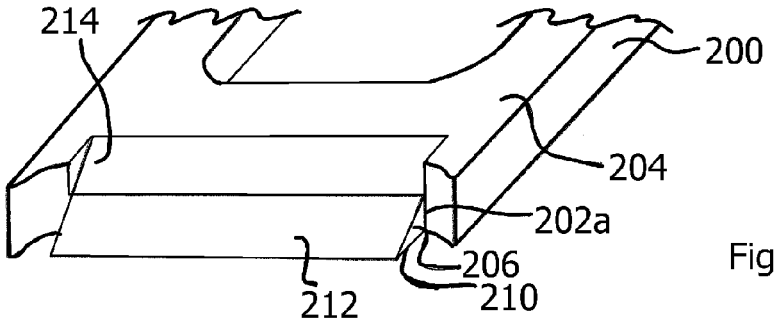
FIG. 23 is a perspective view of the FIG. 22 device in a second configuration.

FIGS. 22 & 23 show a base unit 200 having a front face 202 that extends downwards and backwards relative to the vertical at about 5 degrees. The base unit 200 is designed to have an upright wall such as wall 14 of FIG. 1 located on its upper surface 204. For clarity mounting points are not shown.

Mounted on The base unit 200 is a movable portion 206 that extends across a major portion of the front face 202. This movable portion 206 is triangular in cross section, as seen in FIG. 23, and is pivotably attached to the base unit at or adjacent its lower edge 208, as seen in FIG. 22. The base unit 200 has a recess into which the movable portion 206 is received.

The movable portion 206 may be positioned in one of two positions, as seen in the figures. In FIG. 22 the movable portion 206 is closed and the front face is substantially continuous at its 5 degrees to the vertical. In this position a ball kicked along the ground against the front face 202 will be rebounded along the ground.

In the lowered position, as seen in FIG. 23, the movable portion 206 is rotated approximately 180 degrees so that the portion 202*a* of the front face opposes the front face 202 and its upper face 210 rests on the ground, generally horizontally. The third face 212 of the movable portion 206 thus extends upwards and backwards. The third face 212 and the face 214 of the base thus form a ramp. In use a ball kicked along the ground will roll up or be lifted up the ramp and will rebound in the air to the user.

The faces 212 and 214 need not be planar and may be curved in the direction generally perpendicular to the axis of rotation 208. One or both of these faces may be concave or convex. The faces 212 and 214 may also be curved across the axis of rotation 208. It is not necessary that the faces 212 and 214 contact each other when the movable portion 206 is in the closed position shown in FIG. 22.

Whilst the movable portion 206 in the embodiment described rotates about an axis, it will be appreciated that other methods may be used to allow positioning in the two positions. For example, the portion 206 and base unit may be provided with complementary tongue and grooves that allow the movable portion 206 to be slotted into one of two or more positions.

The base unit of FIG. 22 has two rearward extending legs 220 that define an opening 222 between themselves. This embodiment may have a separate ballast unit 224 that is shaped to fit within the opening 222. The ballast unit 224 may be filled with water or sand via one or more fill holes 226. Use of a ballast unit behind rather than below the base unit 204 results in the base unit 204 remaining on the ground whether the ballast unit is used or not.

The embodiments of the invention may be provided with wheels to aid in movement. The wheels may be attached to the free ends of the legs for transport or be incorporated in the free ends of the legs. Preferably the wheels extend rearwards and in the normal position do not engage the ground. Lifting the front of the device causes the wheels to engage the ground and the device can then be wheeled across the ground.

Unless the context clearly requires otherwise, throughout the description and the claims the words 'comprise', 'comprising', and the like are to be construed in an inclusive sense as opposed to an exclusive or exhaustive sense; that is to say, in the sense of "including, but not limited to".

It will be apparent to those skilled in the art that many obvious modifications and variations may be made to the embodiments described herein without departing from the spirit or scope of the invention.

The claims defining the invention are as follows:

1. A rebound wall for ball games including a face, against which a ball may be struck, the face having a lower portion and an upper portion, wherein the lower portion is angled downwards and backwards relative to the vertical, and the upper portion is angled upwards and backwards relative to the vertical, wherein a part of the lower portion is defined by a first surface of a movable element, the movable element having a second surface, the element movable between first and second operative positions, wherein:

in the first operative position the first surface is substantially aligned with the rest of the lower portion, and in the second operative position the second surface is exposed and is angled downward and forward to form a ramp.

2. The rebound wall of claim 1 wherein the face includes at least one curved section.

3. The rebound wall of claim 1 wherein the lower portion is angled downwards and backwards at about 5 degrees to the vertical.

4. The rebound wall of claim 1 wherein the upper portion can be located in at least two different positions relative to the lower portion.

5. The rebound wall of claim 4 wherein in one of the positions the upper portion is at approximately vertical.

6. The rebound wall of claim 4 wherein in one of the positions the upper portion is at approximately 30 degrees to the vertical.

7. The rebound wall of claim 1 having a base unit and a wall unit, the wall unit being mountable on the base unit.

8. The rebound wall of claim 7 wherein the lower portion is on the base unit and the upper portion is on the wall unit.

9. The rebound wall of claim 7 wherein the base unit includes first engagement means and the wall unit includes second engagement means complementary to the first engagement means, whereby the base unit and wall unit may be engaged together.

10. The rebound wall of claim 9 wherein the wall unit includes at least two second engagement means, the wall unit positioned differently relative to the base unit when each second engagement means is engaged with the first engagement means.

11. The rebound wall of claim 10 wherein the first and second engagement means include sockets and complementary protrusions.

12. The rebound wall of claim 9 wherein the first engagement means includes at least one socket.

13. The rebound wall of claim 9 wherein the second engagement means includes at least one protrusion.

14. The rebound wall of claim 9 wherein the wall unit has a lower edge and one second engagement means includes at least one protrusion extending from the lower edge.

15. The rebound wall of claim 9 wherein the wall unit has a upper edge and one second engagement means includes at least one protrusion extending from the upper edge.

16. The rebound wall of claim 7 wherein the wall unit is mounted on the base unit for rotation about an axis.

17. The rebound wall of claim 7 including at least one strut extending between the wall unit and the base unit.

18. The rebound wall of claim 17 wherein the base unit has at least two mounting locations for the or each strut.

19. The rebound wall of claim 18 wherein each mounting location includes a recess into which the strut is received.

* * * * *